US005498160A

United States Patent [19]

Farina et al.

[11] Patent Number: 5,498,160

[45] Date of Patent: Mar. 12, 1996

[54] TRAINING PROJECTILE

[75] Inventors: Anthony Farina, Hackettstown; Mark Young, Wharton, both of N.J.

[73] Assignee: The United States of America as represented by the Secretary of the Army, Washington, D.C.

[21] Appl. No.: 273,032

[22] Filed: Jul. 7, 1994

[51] Int. Cl.[6] ..... F42B 8/00

[52] U.S. Cl. ..... 434/12; 434/11

[58] Field of Search ..... 434/11, 12, 14, 434/15, 17, 24; 102/382, 395, 561, 503; 244/3.1

[56] References Cited

U.S. PATENT DOCUMENTS

| | | | |
|---|---|---|---|
| 3,955,509 | 5/1976 | Carlson | 102/90 |
| 4,112,843 | 9/1978 | Laviolette | 102/7.6 |
| 4,251,079 | 2/1981 | Earl et al. | 273/428 |
| 4,779,535 | 10/1988 | Maki | 102/501 |
| 4,909,152 | 3/1990 | Reuter | 102/439 |
| 5,005,484 | 4/1991 | Witt | 102/501 |
| 5,148,750 | 9/1992 | Becker et al. | 102/439 |
| 5,228,855 | 7/1993 | Frost | 434/12 |

*Primary Examiner*—Edgar S. Burr
*Assistant Examiner*—V. Srivastava
*Attorney, Agent, or Firm*—Anthony T. Lane; Edward Goldberg; Michael C. Sachs

[57] ABSTRACT

The disclosure is of a projectile having a main body, a nose and a tail including a flared tail member, the projectile having its center of gravity close to the nose thereof.

5 Claims, 1 Drawing Sheet

TRAINING PROJECTILE

The invention described herein may be manufactured, amd used by or for the Government of the United States for governmental purposes.

BACKGROUND OF THE INVENTION

The military have many different types of projectiles of tank and artillery rounds and new ones are being developed constantly. For each operating projectile, an identically shaped training projectile is required for use in training personnel who will use the real or armed projectile. Usually, the design of a training projectile is relatively straightforward, particularly when the projectile is of small diameter. However, a newly developed projectile has a relatively large diameter and the design of a training version thereof which is stable in flight, light in weight and traverses a suitable distance is not straightforward.

SUMMARY OF THE INVENTION

A training projectile embodying the invention has its center of gravity far forward in the body of the projectile and carries, at its rear end, a slotted flared tail piece which provides the desired stability and drag in flight.

DESCRIPTION OF THE INVENTION

Figure 1:
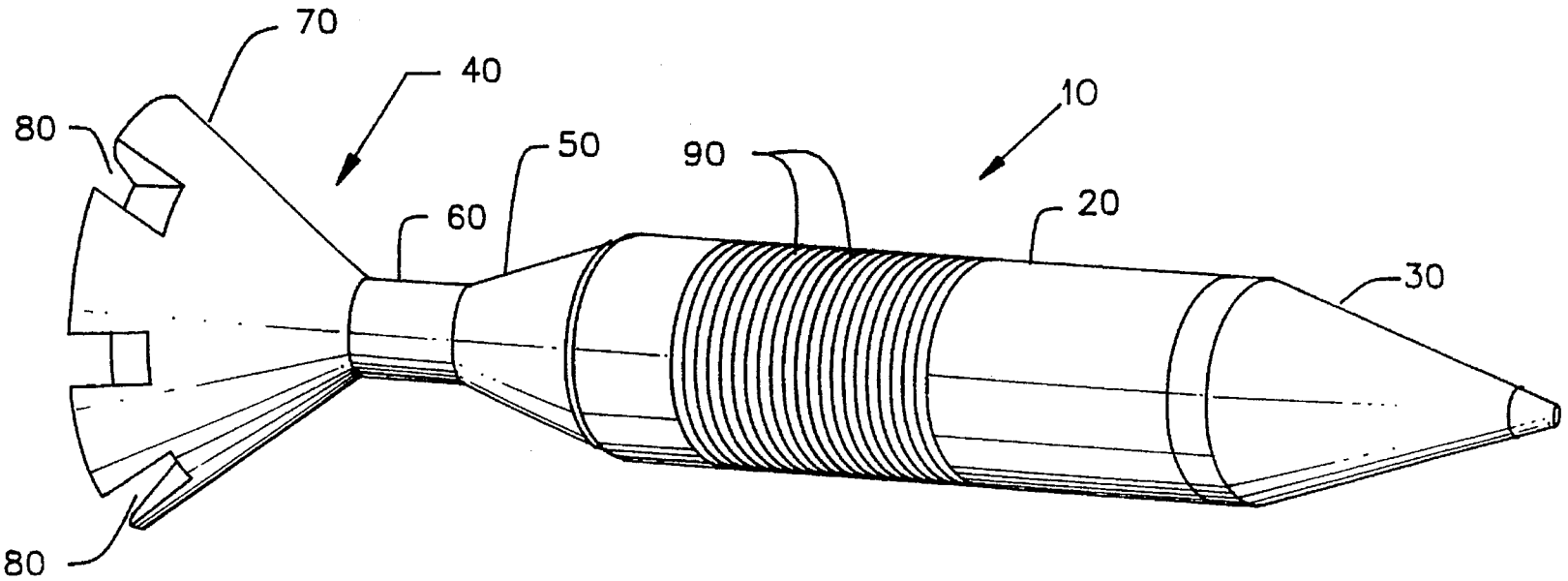
FIG. 1 is a perspective view of the invention.

A training projectile 10 embodying the invention includes a main body portion 20 which is generally cylindrical in form and has a generally conical nose portion 30 and a tail portion 40 including a downwardly tapering portion 50, a short cylindrical portion 60 and a flared tail piece 70.

Figure 2:
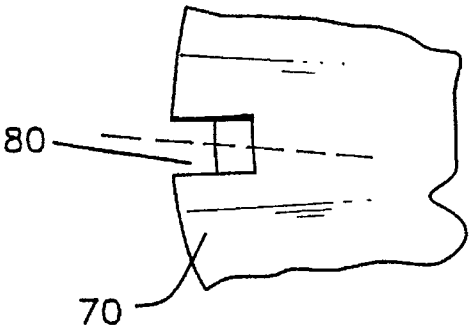
FIG. 2 is a plan view of a portion of the device of FIG. 1.

According to the invention the flared tail piece 70 tapers outwardly from a small diameter to a larger diameter and the large diameter end has a plurality of generally rectangular slots 80 disposed about its surface. As illustrated in FIG. 2, the slots 80 are preferably disposed at a small angle to the longitudinal line (shown dashed) which runs through each along the wall of the flared tail piece. This angle, in one embodiment of the invention, is one degree.

According to the invention, the center of gravity of the projectile 10 is as close to the nose cone 30 as possible and this is achieved by having the nose and perhaps one fourth or one third of the body made of steel or another relatively heavy weight material and the remainder of the projectile made of aluminum, or another relatively lightweight material about ¾" thick.

In one embodiment of the invention, the projectile had a length of about 660 mm, the main body 20 had a diameter of about 80 mm, and the center of gravity was about 200 to 250 mm from the tip of the nose.

In operation of a projectile 10 embodying the invention, with the center of gravity near the front of the projectile, the flare tail piece 70 provides great stability and a favorable drag which limits the operating range of the projectile, as desired.

What is claimed is:

1. A training projectile adapted to fly through the air with limited range, comprising:

a main cylindrical body having a front end and a rear end and a predetermined diameter, a generally conical nose cone at the front end of said main body, a tail portion at and extending from the rear end of said main body, said tail portion comprising a flared member which flares outwardly from said rear end of said main body to a tail portion end and provides drag in flight to limit the length of the flight, and means to impart spin to said projectile and thereby impart stability in flight, said means including a plurality of slots in said flared member at said tail portion end, said slots being disposed at an angle to the longitudinal axis thereof to impart spin to the projectile and thereby said projectile having its center of gravity closer to said nose than to said tail portion.

2. The projectile defined in claim 1 wherein tail portion and has a larger diameter than said body.

3. The projectile defined in claim 1 wherein said nose is made of a heavy weight material and the greater portion of said main body and said tail are made of a lightweight material whereby the center of gravity of said projectile is close to the nose thereof.

4. The projectile defined in claim 1 wherein said nose and a portion of the main body secured thereto being of steel and the remainder of said main body and said tail being of aluminum.

5. The projectile defined in claim 1 wherein said angle is about one degree.

* * * * *